US007202619B1

(12) United States Patent
Fisher

(10) Patent No.: US 7,202,619 B1
(45) Date of Patent: Apr. 10, 2007

(54) VARIABLE FREQUENCY DRIVE FOR AC SYNCHRONOUS MOTORS WITH APPLICATION TO PUMPS

(76) Inventor: Gary Randolph Fisher, 2240 Federal Ave., Los Angeles, CA (US) 90064

( * ) Notice: Subject to any disclaimer, the term of this patent is extended or adjusted under 35 U.S.C. 154(b) by 0 days.

(21) Appl. No.: 11/361,925

(22) Filed: Feb. 24, 2006

Related U.S. Application Data

(60) Provisional application No. 60/656,043, filed on Feb. 24, 2005.

(51) Int. Cl.
*H02P 1/18* (2006.01)

(52) U.S. Cl. ..... 318/254; 318/138; 318/439; 318/701; 318/461

(58) Field of Classification Search ..... 318/254, 318/138, 439, 700, 701, 811, 461, 799, 807
See application file for complete search history.

(56) References Cited

U.S. PATENT DOCUMENTS 5,668,425 A * 9/1997 Marioni et al. ..... 310/162
5,838,134 A * 11/1998 Cummins ..... 318/750
6,140,795 A * 10/2000 Cummins ..... 318/815
6,264,441 B1 * 7/2001 Marioni ..... 417/423.1
6,687,142 B2 * 2/2004 Scott ..... 363/97

FOREIGN PATENT DOCUMENTS

NZ 332836 * 11/1998

* cited by examiner

*Primary Examiner*—Rina Duda

(57) ABSTRACT

Two apparatuses are disclosed for controlling the speed of an AC synchronous motor-pump utilizing a series of stepped voltage pulses at the driving frequency. The first apparatus is an isolated variable frequency drive comprising step-down transformer 100, full wave rectifier and filter 101, micro-controller 108, driving-voltage array generator 102, gate driver 107, inverter bridge 103 and step-up transformer 104. The second apparatus is a non-isolated high voltage variable frequency drive comprising full wave rectifier and filter 201, low voltage, dual output power supply 205, micro-controller 208, driving-voltage array generator 202, gate driver 207 and inverter bridge 203. Methods are given to determine voltage array values and pulse times to generate a stepped voltage approximation of a sine wave driving waveform.

9 Claims, 8 Drawing Sheets

| STATE | BANK 1 | | | BANK 2 | | |
|---|---|---|---|---|---|---|
| | $Q_{0,1}$ | $Q_{1,1}$ | $Q_{2,1}$ | $Q_{0,2}$ | $Q_{1,2}$ | $Q_{2,2}$ |
| | | | | | | |
| 1 | OFF | OFF | OFF | OFF | OFF | OFF |
| 2 | " | ON | " | ON | " | " |
| 3 | " | OFF | " | " | " | " |
| 4 | " | " | ON | " | " | " |
| 5 | " | " | OFF | " | " | " |
| 6 | " | ON | " | " | " | " |
| 7 | " | OFF | " | OFF | " | " |
| 8 | ON | " | " | " | ON | " |
| 9 | " | " | " | " | OFF | " |
| 10 | " | " | " | " | " | ON |
| 11 | " | " | " | " | " | OFF |
| 12 | " | " | " | " | ON | " |

FIG. 3

VARIABLE FREQUENCY DRIVE FOR AC SYNCHRONOUS MOTORS WITH APPLICATION TO PUMPS

CROSS-REFERENCE TO RELATED APPLICATIONS

This application claims priority of provisional application 60/656,043, which was filed on Feb. 24, 2005.

BACKGROUND OF THE INVENTION

This invention relates generally to the variable frequency control of an AC motor-pump and specifically to a cost effective apparatus for dynamically varying the speed of an AC permanent magnet synchronous motor-pump or more generally an AC synchronous motor driving a pump or other driven device.

AC permanent magnet synchronous motor (PMSM) pumps are widely used in small to mid-size decorative water fountain and aquarium applications. The vast majority of these pumps are submersible. In PMSM submersible pumps the permanent magnet rotor is in contact with water and is magnetically coupled to the motor stator which is encapsulated in a potting compound. The rotor is provided with an impeller structure which in general is moveably attached to the rotor. The PMSM pump speed is proportional to the driving frequency and the number of poles of the motor as it is with all AC synchronous motors. In contrast to AC induction motors these synchronous motor-pumps (as with other AC synchronous motor-driven devices) either run at the synchronous speed or stall.

PMSM pumps generally are available in low voltage (normally 12VAC) and high voltage (110VAC/220VAC) versions and in various flow rates from approximately 30 gallons/hour up to approximately 10,000 gallons-per-hour. Pump power consumption for these pumps runs from approximately 4 watts on the low end to approximately 750 watts for high flow rate PMSM pumps.

There are a number of methods that have been used for varying the speed of an AC motor. Before the advent of micro-controllers AC motor speed controls had been designed using analog techniques. These controllers were complex, expensive and had maintenance issues due in part to component drift. Since the advent of micro-controllers, such analog controllers have been virtually supplanted by units that employ various pulse width modulation (PWM) schemes to vary the frequency of the motor. Especially with large motors the aim of these schemes is to drive the motor with a PWM generated waveform closely approximating a sinusoid, since a sinusoidal waveform (as in mains power) minimizes motor vibration and heating of the motor windings. Some state-of-the-art pulse width modulation schemes for 3-phase AC motors employ space vector pulse width modulation. A micro-controller implementation of space vector technology is taught by Ramarathrum (U.S. Pat. No. 6,316,895).

In large-motor applications it is critical to reduce vibration and motor winding overheating to avoid premature failure of the motor. A significant amount of on-going research is directed towards developing optimal PWM schemes directed towards reducing unwanted harmonics which contribute to motor vibration (see, for example Czarkowski, D., at. al., (2002). *IEEE Transactions of Circuits and Systems—Fundamental Theory and Applications.* 48:4, pp. 465–475.)

While use of such PWM schemes is critical in large motor applications even though posing significant theoretical and computational difficulties, such schemes can be overkill for controlling the much smaller fractional horsepower AC synchronous motor driven pumps such as described above.

A much simpler approach has been used specifically to control small submersible AC PMSM pumps of the type in widespread use in small fountain applications. U.S. Pat. No. 6,717,383 teaches an apparatus for effectively controlling these small pumps. The waveform so generated is essentially a variable-width square wave pulse separated by a variable width-dead time. Use of such a simple waveform—while appropriate and cost effective for very small PMSM pumps such as have been widely used in the indoor fountain market—can potentially produce unacceptable vibration when used to control many of the larger PMSM pumps that are also used in the fountain and aquarium industries.

Thus what is needed is a cost effective apparatus to control low-to-medium power AC synchronous motor pumps that provides more complex waveforms than employed in U.S. Pat. No. 6,717,383 while avoiding the computational drawbacks of using conventional, computationally intensive pulse width modulation techniques to generate the AC waveform. It should be emphasized that such cost effective apparatus is also directly applicable to controlling AC synchronous motors, and in the case of some induction motors may afford finer control than many Triac-based, variable-duty-cycle control implementations.

BRIEF SUMMARY OF THE INVENTION

It is a primary objective of this invention to provide a means of driving an AC synchronous motor pump over a range of realizable frequencies wherein the AC waveform is generated at the driving frequency using a multiplicity of stepped voltage pulses of predetermined widths which vary with the driving frequency of the synchronous motor.

It is another objective of this invention to provide means of generating a multiplicity of voltages for feeding a modified H-bridge inverter in which the AC pulsed driving waveform is generated.

It is another objective of this invention to provide a micro-controller with embedded software for sending the appropriate sequence of switching signals to the inverter bridge so as to generate a predetermined sequence of motor-pump frequencies.

It is another objective of this invention to provide a method of generating the driving waveform with a voltage-stepped approximation of a sine waveform so as to minimize motor-pump vibration and motor winding overheating.

These and other objects of the invention are met by the following apparatus:

An apparatus for varying the speed of an AC synchronous motor pump (or more generally an AC synchronous motor) comprising a voltage array generator for generating a multiplicity of voltages for use in generating stepped voltage pulses, a modified H bridge inverter for directly generating a voltage-stepped AC driving waveform at the driving frequency to drive said pump utilizing said multiplicity of voltages and predetermined pulse times, a micro-controller with an embedded software program for generating switching signals to said bridge for sequencing the formation of the AC waveform and setting the duration of said pulse times and micro-controller means for varying said pulse times as a function of the desired driving frequency so as to vary the synchronous speed of the motor-pump.

BRIEF DESCRIPTION OF THE DRAWINGS

FIG. 3 is a state diagram for one complete cycle for the case of two voltage levels.

DETAILED DESCRIPTION

Figure 1:
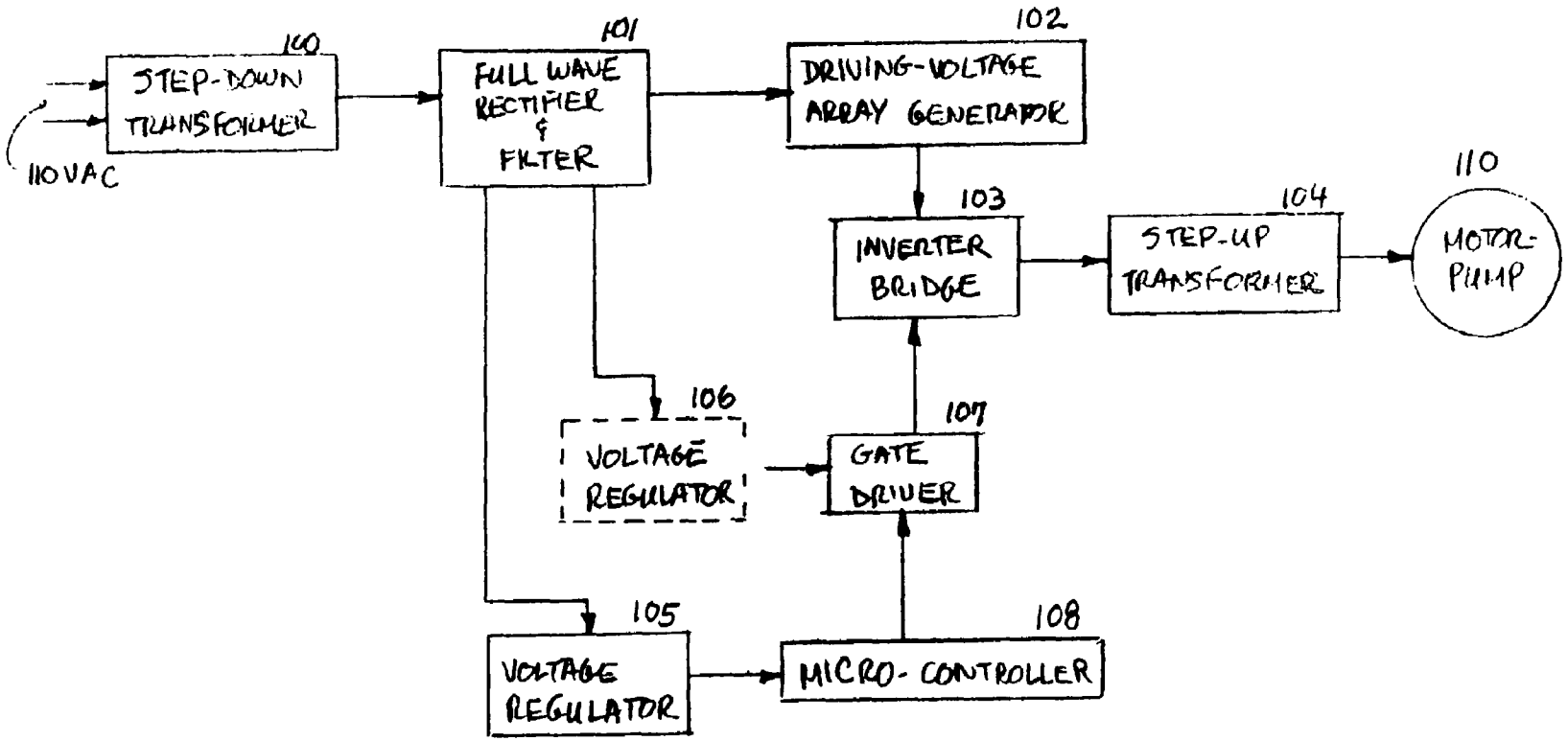
FIG. 1 is a block diagram of an isolated, variable frequency drive according to this invention.
Figure 8:
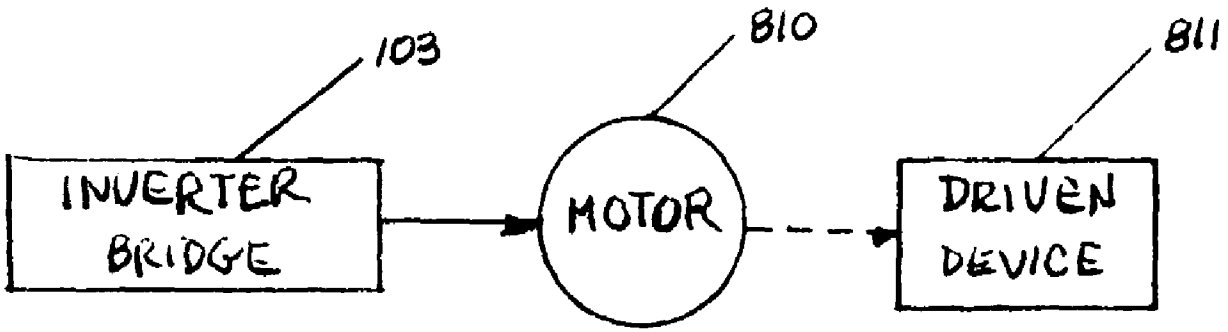
FIG. 8 is a block diagram showing the inverter bridge in FIG. 1 directly powering a motor.

FIG. 1 shows a block diagram of the first embodiment of the variable frequency drive of this invention wherein internal electronics are isolated from the mains. FIG. 1 shows motor-pump 110 as the driven device. Motor-pump 110 is assumed to be an AC device. Examples of 110 would be a submersible AC permanent magnet synchronous motor (PMSM) driven pump as used in the fountain and aquarium industries, an AC synchronous motor coupled to a pump or other driven device, or an AC induction-type motor coupled to a pump or other driven device. AC PMSM pumps are discussed throughout this disclosure since this type of device constitutes a large market arena for AC motor driven devices. This non-withstanding, it should be emphasized that, according to this invention, in all of the above cases it is the motor that is being controlled and not the driven device (i.e. a pump). FIG. 8 elucidates this by showing the inverter bridge 103 of FIG. 1 directly powering motor 810. A dotted connection from 810 to driven device 811 indicates not only that an arbitrary driven device may be specified but also indicates that the motor may be driven according to this invention in the complete absence of a driven device such as, for example, a pump.

With reference to FIG. 1 it is assumed that either 110VAC or 220VAC is available as a power source. Step-down transformer 100 reduces the mains voltage to low voltage AC (i.e. 12–28 VAC) and serves to isolate downstream electronics and the motor-pump from the line. This can be of importance especially if the drive is to be used in close proximity to a salt-water environment such as for instance a salt-water aquarium.

If the motor-pump 110 is low voltage (i.e. 12VAC) step up transformer 104 is not needed and can be eliminated. Note that it is advantageous under some conditions in the low voltage case to have a step-down transformer 100 of higher voltage rating that the voltage rating for the motor-pump. This is to allow the motor-pump to be considerably overdriven beyond the motor's design frequency, if desired.

Full wave rectifier and filter block 101 preferably comprise a full wave bridge rectifier and a simple capacitive filter. Assuming a 110VAC to 24VAC transformer, the filtered DC output from 101 is 34 volts. Voltage regulator 105 supplies regulated 5 volts to power micro-controller 108. Voltage regulator 106 supplies a DC voltage to gate driver 107. Voltage regulator 106 can be removed if the gate driver does not require a separate voltage source to operate. Conventionally, gate driver 107 is opto-isolated from micro-controller 108 in either low voltage or high voltage topologies.

Rather than the single supply voltage (or bus voltage) used in conventional PWM schemes, the present invention generates a sequence of voltage levels for direct use in inverter bridge 103. This allows an approximation to a complex waveform to be generated directly and requires less computational power than conventional PWM schemes which typically must operate at a carrier frequency many times greater than the desired motor-pump frequency. The approach of this invention also causes less stress to inverter power transistors and less problems with excessively heating the motor-pump windings due to dV/dt considerations when compared to conventional PWM schemes using a single bus voltage.

Driving-voltage array generator 102 generates a sequence of n DC voltages $V_1<V_2<V_i<V_n$. In this embodiment of the invention these voltages are preferably set by n adjustable linear regulators. For current requirements up to 10 amps and a supply voltage in the 30VDC range, such regulators are inexpensive and require at a minimum two resistors to set the voltage and a capacitor to prevent transients from damaging each regulator IC. For optimal flexibility in setting the voltages, trim pots can be used. More expensive options include a multi-tap transformer followed by appropriate rectification and filtering, or various DC—DC converter topologies.

Inverter Bridge 103 comprises an array of power transistors connected in a modified H-bridge configuration. These transistors are preferably power MOSFETS or IGBTs. Inverter bridge 103 is preferably configured as is shown in FIG. 2 for the case of three voltage levels.

Note that the number of power transistors required is two times the number of voltage levels feeding the inverter in 102 plus two (for the zero voltage transistors—one for each bank). For example the number of power transistors required for three voltages is 8. The three-voltage case shall be used for the discussion to follow, although more or less voltage levels may be the minimum required to effectively drive a specific motor-pump over its desired, realizable range.

Figure 2:
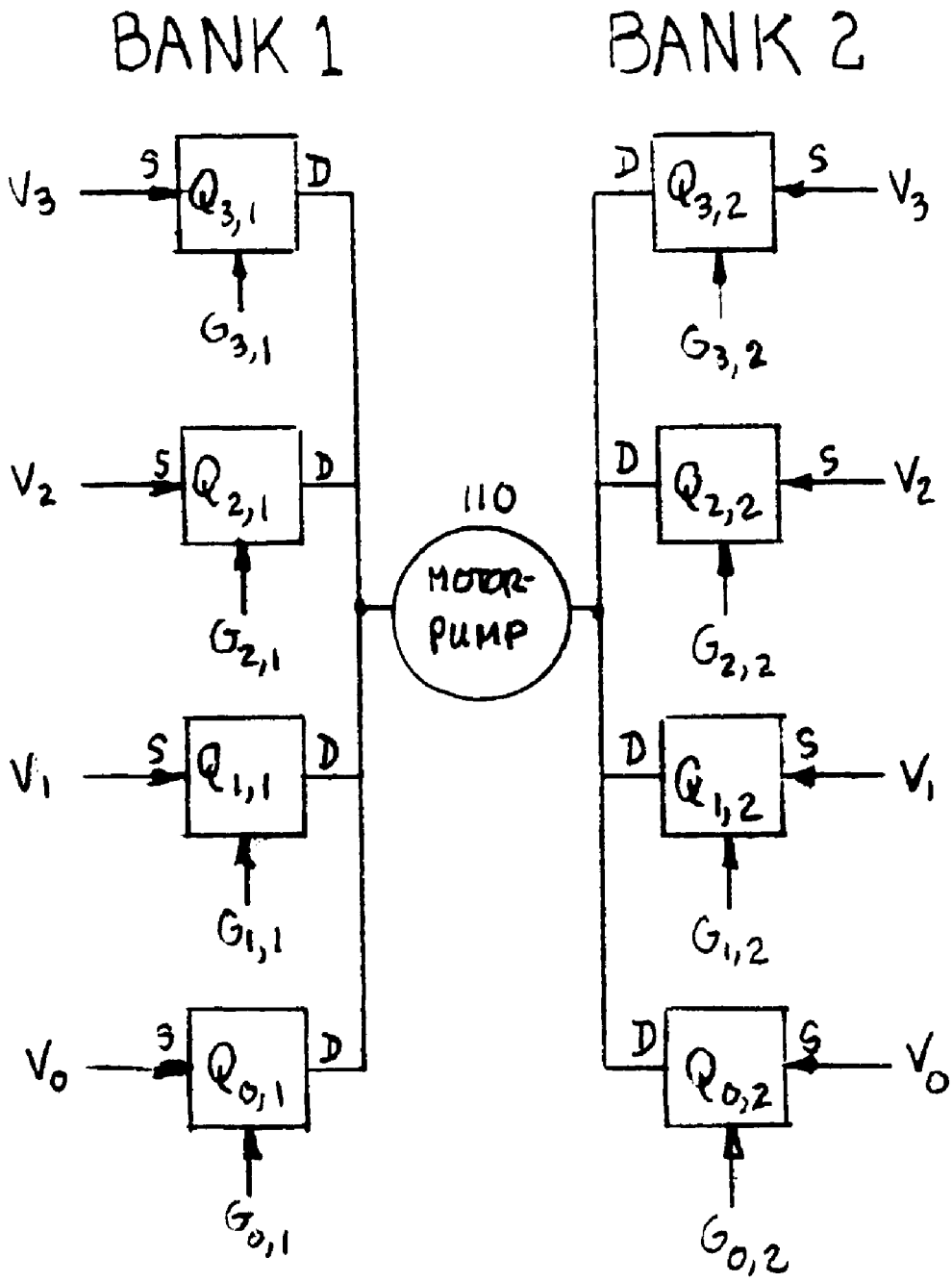
FIG. 2 is the inverter bridge configuration for the case of three voltage levels.

With reference to FIG. 2 for the three voltage case the sources S of bank 1 transistors $Q_{1,1}$,$Q_{2,1}$ and $Q_{3,1}$ are connected to voltages $V_1$, $V_2$ and $V_3$ respectively and the source of $Q_{0,1}$ is connected to $V_0$ (zero volts). The drains D of transistors $Q_{0,1}$,$Q_{1,1}$,$Q_{2,1}$ and $Q_{3,1}$ are connected together and feed one leg of the single-phase motor-pump 110 as shown. Transistors $Q_{0,2}$, $Q_{1,2}$, $Q_{2,2}$ and $Q_{3,2}$ are similarly connected and feed the other leg of AC motor-pump 110.

Micro-controller 108 controls inverter bridge 103 via gate driver 107. A main function of micro-controller 108 is to turn transistors $Q_{0,1}$,$Q_{1,1}$,$Q_{2,1}$,$Q_{3,1}$, $Q_{0,2}$, $Q_{1,2}$, $Q_{2,2}$, and $Q_{3,2}$ on and off in a predetermined sequence for predetermined times via gate driver 107 to generate the waveform driving the motor-pump. Aside from the specifics of this generation (which shall be discussed later in this disclosure), the drains of the transistors in each bank are wired in a direct short condition. This is typical of many inverter bridge configurations. Thus a necessary condition for proper operation of the bridge is for only one of the transistors in each bank to be on at any given time. A second necessary condition is that, for each bank, a transistor in the on state must be turned off for a minimum time before another transistor in the same bank is turned on. This minimum time must be greater than the physical switching time of the transistor to avoid a short circuit. This time period is notably short; for example, IGBTs are capable of switching state in approximately 0.1 microseconds. A further necessary condition is that one bank must be at zero volts while the other bank is generating one-half of the waveform. These conditions must be satisfied by appropriate programming of micro-controller 108.

Methodologically, an entire cycle is developed by generating ½ of the waveform in bank 1 while keeping bank 2 at zero volts, followed by holding bank 1 at zero volts while generating the second half of the waveform in bank 2. This is repeated at the driving frequency.

FIG. 3 is a state table for one complete cycle for the case of two voltage levels. Note that there is a reset state turning a given transistor in a given bank off (for a brief time interval) before any other transistor in the given bank is turned on. In general the number of states, $\phi$ is given by:

$\phi=8n-4$, where n is the number of voltage levels.

Figure 4:
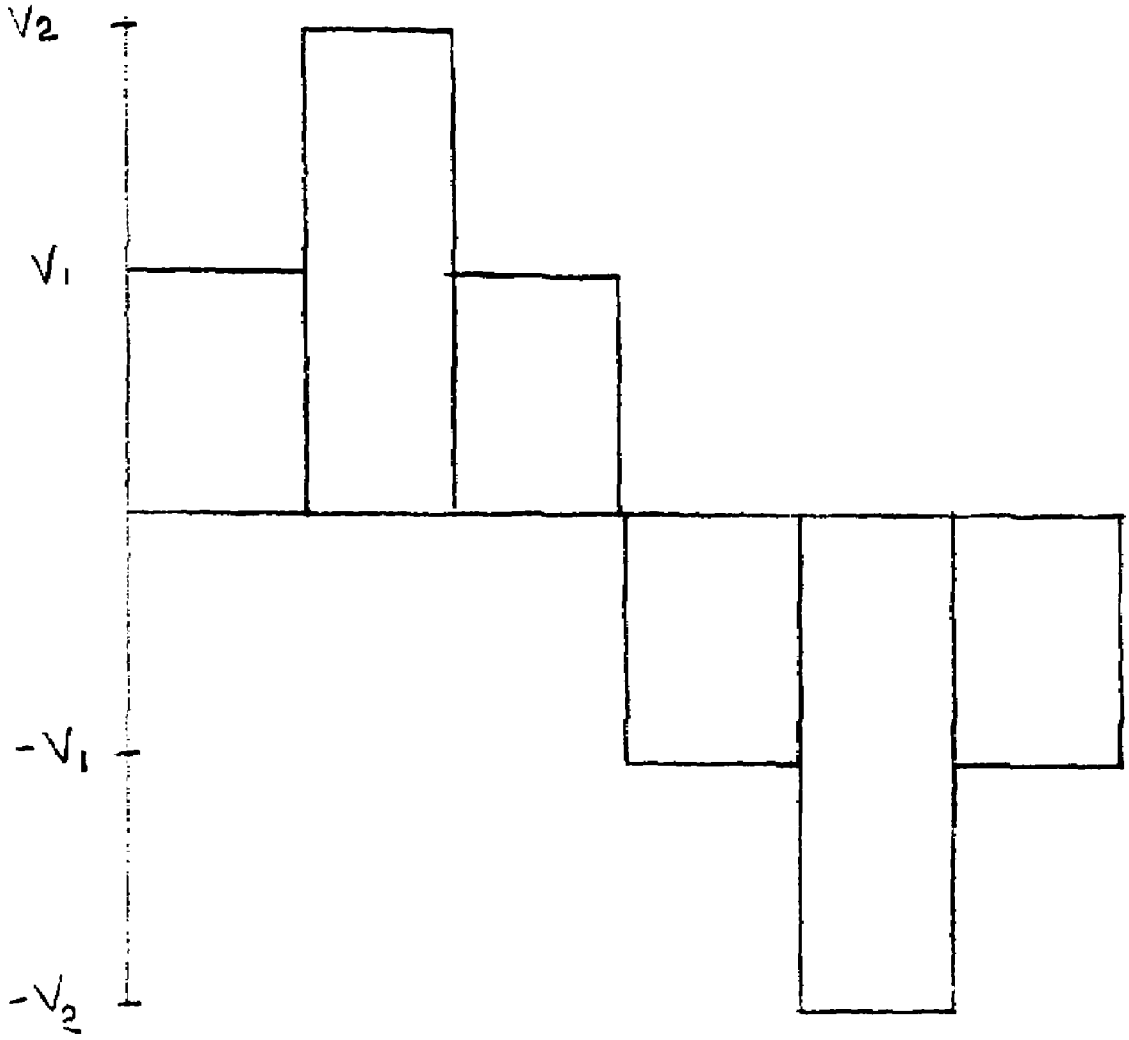
FIG. 4 shows one cycle of a stepped voltage waveform for the case of two voltage levels.

Implementation of the state table in FIG. 3 will result in a sequence of stepped voltage pulses each of which is maintained for a pre-determined time interval (to be described shortly). One such cycle is illustrated in FIG. 4 for the case of two voltage levels $V_1$ and $V_2$. Due to the scale of the depiction (milliseconds) the brief (of the order of a few microseconds) delay between each successive pulse is not shown.

The specifics of waveform generation shall now be discussed. For simplicity of exposition the inventor has chosen to express his exposition in the time domain.

While a variety of waveforms can be contemplated that may have advantages under certain conditions, one preferred waveform is a stepped sine wave approximation wherein all pulses have equal area in relationship to an ideal sine waveform.

Consider that n voltages $V_1, V_2, \ldots, V_{i-1}, V_i, \ldots, V_n$ are to be provided to inverter bridge 103. In general $V_n$ is the rectified supply voltage and the n−1 other voltages are generated by driving-voltage array generator 102. For maximum flexibility $V_n$ could also be set by its own adjustable regulator.

Further consider ¼ of a sinusoidal waveform sin(ωt) from 0 to π/2 and let $\theta_{i-1}$ and $\theta_i$ be two angles in the interval corresponding to voltages $V_{i-1}$ and $V_i$.

It is desired to find the set of sequential angles $\{\theta_1, \theta_2, \ldots, \theta_{i-1}, \theta_i, \ldots, \theta_n\}$ such that the areas under all waveform pairs $(\theta_{i-1}, \theta_i)$ are equal. This condition for $0<i\leqq n$ met by:

$$\cos^1(\theta_i)=\cos(\theta_{i-1})-1/n, \qquad \text{EQ 1}$$

where $\cos(\theta_0)=1$ provides a starting point.

Now given the set of angles so computed, the value of the $i^{th}$ voltage to be generated in voltage array generator 102 is given by:

$$V_i=V_n*\sin(\theta_i) \qquad \text{EQ 2}$$

By first computing these n−1 voltage levels the adjustable voltage regulators (or other voltage-setting means) in 102 can be correspondingly set.

Now assume that it is desired to run the motor-pump at some frequency ω=f, where f is in hertz. It can be shown that the i-th pulse time is given by:

$$t_i=(\theta_i-\theta_{i-1})/(360*f),\ 0<i<n, \qquad \text{EQ 3}$$

where $t_0=0$ by definition and $t_i$ is in seconds.

For the following example, assume that the motor-pump is to be driven at 60 hz. This corresponds to a quarter cycle of 4.17 ms. Also, assume that three voltage levels $V_1, V_2, V_3$ are to be specified. Assume further that step down transformer 100 is 110VAC to 24VAC; after rectification and filtering this gives a $V_3$ of 34 volts DC. By equations 1, 2 and 3 we obtain the following values for θ, V and t: $\theta_1=48.70$, $V_1=25.5$v, $t_1=2.25$ ms; $\theta_2=70.70$, $V_2=32.0$v, $t_2=1.02$ ms; $\theta_3=90°$, $V_3=34$v, $t_3=0.9$ ms.

Figure 5:
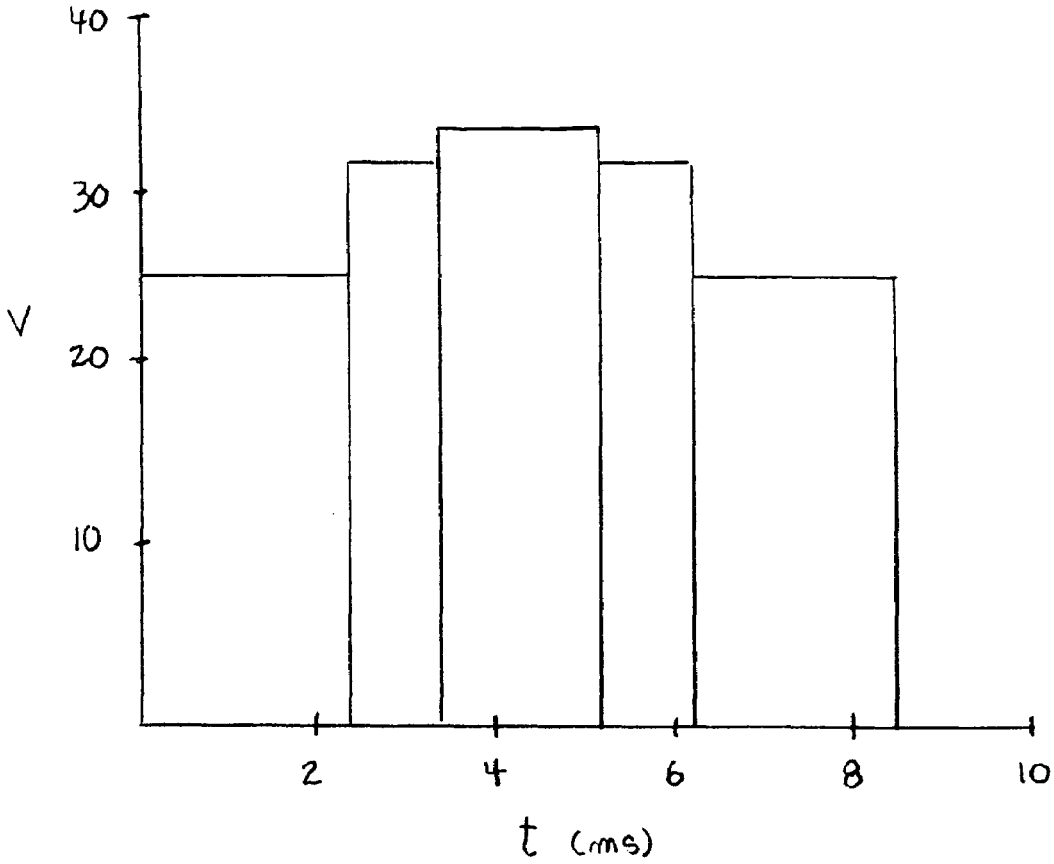
FIG. 5 is a graphical depiction of ½ cycle of sine wave approximation at 60 hz with pulses at three voltage levels.

FIG. 5 is a graphical depiction of ½ cycle of a sine wave approximation at 60 hz with pulses at three voltage levels. Due to the scale of the depiction (milliseconds) the brief (of the order of a few microseconds) delay between each successive pulse is not shown. This turn-off/turn-on delay is to insure that a given transistor is completely off before the next appropriate transistor is turned on for the next pulse. Note that each half of the AC waveform is symmetrical around 4.17 ms and that the central pulse actually has a width of $2*t_3$ at voltage level $V_3$. In general the number of pulses per half cycle is one less than twice the number of voltage levels.

Figure 6:
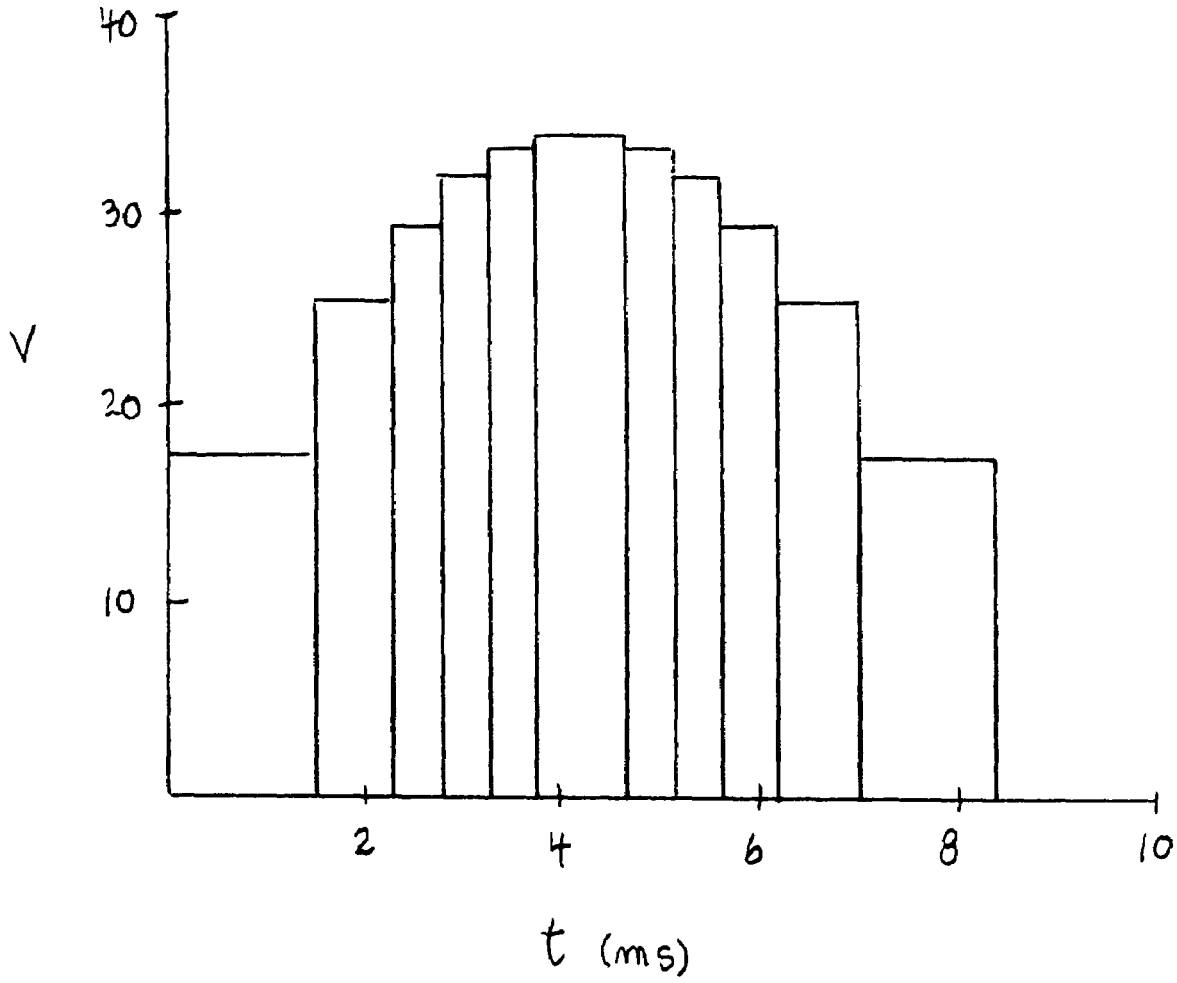
FIG. 6 a graphical depiction of ½ cycle of a sine wave approximation at 60 hz with pulses at six voltage levels.

FIG. 6 is a graphical depiction of ½ cycle of a sine wave approximation at 60 hz with pulses at six voltage levels. As would be expected, the approximation becomes more accurate as more voltage levels are employed. As in FIG. 5, the delay between successive pulses is not show.

Figure 7:
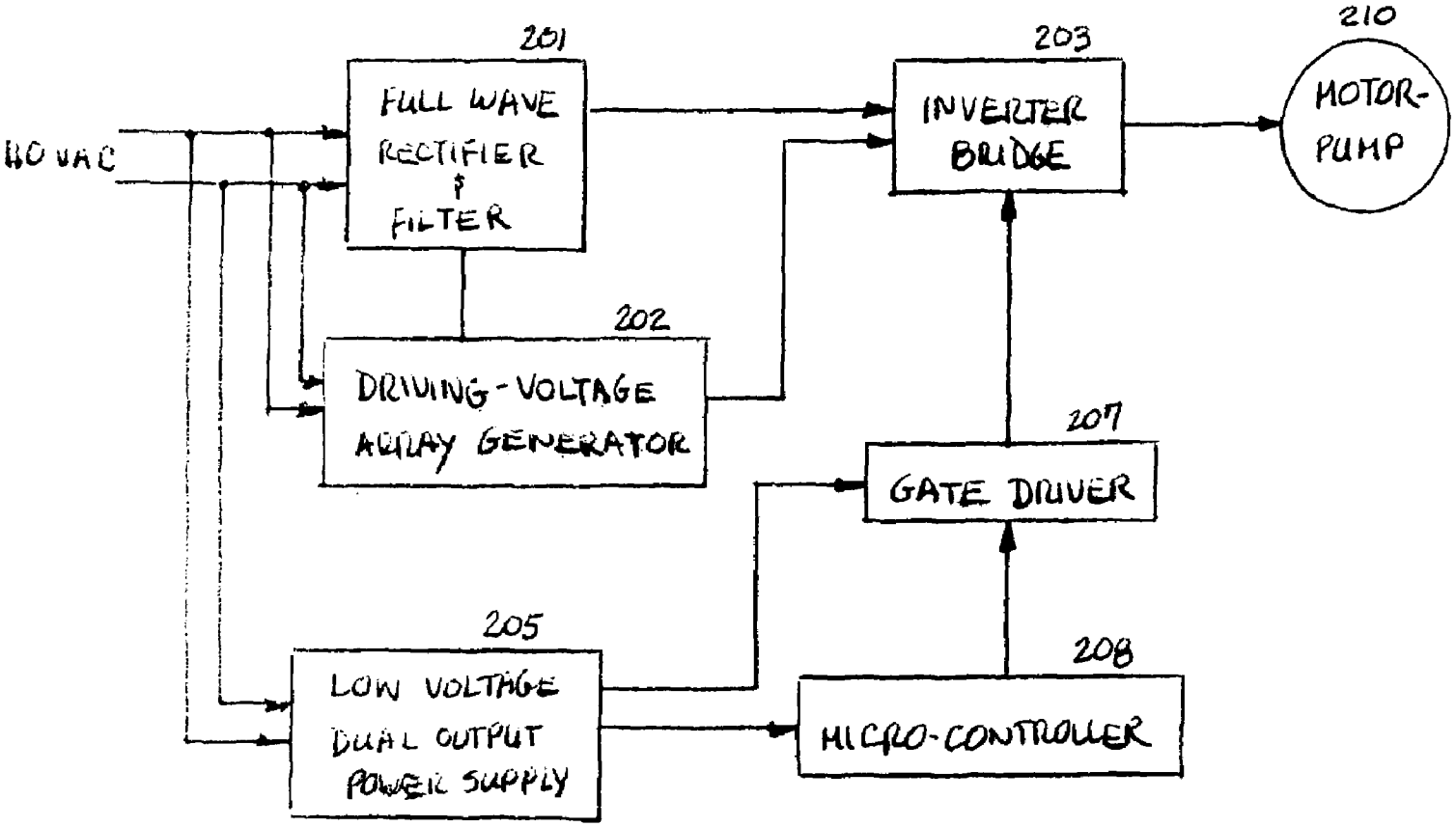
FIG. 7 is a block diagram of a high voltage non-isolated high voltage, variable frequency drive according to this invention.

In order to generate pulse times for variety of increasing driving frequencies $f_1, \ldots, f_m$, where m is the number of frequencies, it is methodologically a matter of using equations 1 and 3 to calculate the set of pulse periods for each driving frequency from 1 to m where m is set for a given implementation of FIG. 1 or FIG. 7. From a software perspective, one way of doing this is to include a two-dimensional array in the micro-controller program where for each driving frequency the set of $t_n$ pulse times are stored. This array can then be addressed when generating the waveform for any driving frequency desired within in the range. For the case of three voltage levels and 16 driving frequencies this array would require 48 words. Alternatively, after appropriate scaling the n values of θ and f, equation 3 could be used to calculate pulse times on the fly.

Other approaches to the general waveform approximation above can be considered. For instance one could weigh the central portions of each ½ waveform more than the less central portions. Especially for low numbers of generated voltage levels, this might conceivably give a more gradual build up of the waveform and reduce unwanted motor vibration especially for the less powerful motor-pumps or other motor-driven devices. One such approach would be to equally divide the ¼ wave into n equal intervals.

More modifications to the generated waveform can also be considered. For example, subsets of the voltage array could be used to drive the motor-pump or motor-driven device at frequencies below that with which the motor-pump could be driven using the entire array. This could greatly extend the lower range of control.

Another modification to facilitate driving the motor-pump or motor-driven device at low driving frequencies would be to adapt the dead time approach as used in U.S. Pat. No. 6,717,383. In this case the positive and negative components of the waveform would be separated by a zero voltage dead time interval td. For a given frequency the total cycle time would be composed of twice the pulse time intervals plus twice the dead time interval. In practice, the dead time interval td would be increased as the driving frequency is decreased. This would in effect provide less power to the motor-pump as frequency decreased which would facilitate motor-pump operation at these lower frequencies.

Another somewhat provocative modification would be to use pulse width modulation techniques applied to the set of voltages $\{V_n\}$ used to generate the waveform according to this invention. As an example, let n=2 and let k be the number of pulses to be generated for each of the two voltages in each ½ cycle (π) of the waveform. Then for the full cycle (2π) there would be 2*k pulses (with appropriate inter-pulse dead times) per cycle. If k=20 and the driving frequency is 60 hz, the pulse frequency would be 2400 pulses/second to generate the waveform. It would be clearly advantageous to reduce k.

Pulse modulating the stepped voltage levels would require re-formulating the optimal PWM problem to cover not one but several driving voltages. One result that may be conjectured is that the number of required pulses for the optimal PWM case when more than one driving voltage is used would be considerably less that in the traditional case of one driving voltage to obtain the same waveform fidelity. Since k can be large (50 and up) for conventional PWM schemes used in motor control based on one voltage level, reducing k has obvious practical significance. Another advantage of the technique of combining PWM techniques with the instant invention might be a reduction in dV/dt issues. The present invention clearly anticipates such PWM modifications that might be implemented in the future.

FIG. 7 shows a block diagram of a non-isolated high voltage, variable frequency drive according to this invention. This apparatus is intended to drive 110VAC motor driven pumps or other devices from the 110VAC mains at high internal voltage levels (namely up to the order of 170VDC).

High voltage full wave rectifier and filter 201 provides $V_n$ which is the high DC voltage feeding driving-voltage array generator 202 and inverter bridge 203. Low voltage power supply 205 generates regulated 5VDC to power micro-controller 208 and DC voltage (if required) to power gate driver 207. As was stated earlier, it is common practice to opto-isolate the micro-controller from the high end of the circuit. Such opto-isolation is also normally the case in Triac-based circuits for varying the speed of some induction-type motors.

One embodiment of 205 is a 110VAC to 12VAC step-down transformer followed by a rectifier, filter and dual voltage regulators to provide regulated 5VDC and appropriate DC voltage for the gate driver (if required). An inexpensive non-line-isolated alternative to a step-down transformer is to use the SR036 dual output off-line controller from Supertex, Inc. in Sunnyvale, Calif. in a simple circuit to provide the required regulated 5VDC to power the micro-controller and (by adding one voltage regulator) the regulated voltage to power the gate driver (if, required). This alternative offers no galvanic isolation on the low voltage side of the circuit which is generally of no consequence since the high voltage driving circuitry is also non-isolated from the line. Note that gate driver 207 may not be required as some power MOSFETS can be driven directly from TTL logic.

A major difference between the high voltage embodiment in FIG. 7 compared to the embodiment in FIG. 1 is internal to the DC driving-voltage array generator 202. The issue in 202 is to provide a sequence of DC voltages in the range of say 25–150 VDC. There are several ways of doing this. On the low side a 110VAC to 28VAC step-down transformer can be used with rectification, filtering and adjustable voltage regulators to provide voltage levels below 40VDC.

One option to obtaining voltages on the high end is to employ DC—DC buck converter or flyback topologies. Power Integrations in San Jose, Calif. manufactures the TOPSwitch®-GX family of off-line switchers which are capable of handling over 200 watts in buck converter or flyback topologies. This is more than adequate to handle PMSM pumps of up to 6000 gallons-per-hour (gph) having power requirements of over 500 watts. Note that once below 100VDC there are adjustable regulator solutions to provide lower voltages without requiring the step-down transformer above. For instance National Semiconductor manufacturers adjustable step-down switching regulators with a maximum input voltage of 100VDC and current capabilities of up to 100 A.

Another option for generating voltages on the high end would be a low ratio step-down transformer run directly from the mains. For low power applications such transformers for PCB mounting are available. For instance TRIAD makes a 130 ma 110VAC to 88VAC transformer. Higher current versions are of course available by special order. Clearly, another approach, if volume dictates, would be a multi-tap transformer to generate the voltages.

One cost effective approach to driving higher power pumps utilizing the stepped voltage pulse paradigm (method) of this disclosure while minimizing component heating issues would be to pulse a significant percentage of the power in the $V_n$ (supply) pulse. For example assume two voltages $V_1$ and $V_2$, where $V_2$=170VDC is the rectified and filtered line (assuming 120VAC). Consider that it is desired to run motor-pumps up to a maximum power requirement of 250 watts. Then if inverter 203 would put 75% of the power in the $V_2$ pulse and the $V_1$=102 VDC pulse would require only 62.5 watts rather than 125 watts with the $V_1$=147VDC pulse from equation 1.

Clearly, the specific implementation of 202 will depend on the maximum power PMSM pump to be driven. As a few examples from German pump manufacturer OASE, the 55 watt OASE Aquarius 1000 has a maximum flow rate of 1000 gallons per hour (gph); the 125 watt OASE Aquarius 2000 has a maximum flow rate of 2000 gph; the 260 watt OASE Atlantis 3000, designed for waterfall applications, has a maximum flow rate of 3000 gph and has a maximum head of 19 feet; the 490 watt OASE Aquamax 6000 has a maximum flow rate of 6000 gph and has a maximum head of 20 feet.

Although there has been shown and described hereinabove specific arrangements for controlling the speed of an AC motor-pump or other AC motor driven devices for the purpose or illustrating the manner in which the invention may be used to advantage, it will be appreciated that the invention is not limited thereto. Accordingly, any and all modifications, variations, or equivalent arrangements, which may occur to those skilled in the art, should be considered to be within the scope of the invention. Clearly, the arguments for using PWM schemes with more than one pulsed bus voltage apply to both embodiments of the invention. As was stated before, an obvious application of the disclosure is in the control of an AC motor not combined with or having an integral pumping mechanism. Of note in this regard is the control of some AC induction motors where typical variable-duty-cycle approaches may not be appropriate, and in the VFD control of AC synchronous motors used to drive a variety of other non-pump devices.

I claim:

1. An apparatus for varying the speed of an AC motor comprising:

a. voltage setting means generating a multiplicity of increasing DC voltage levels for application in a predetermined pulsed fashion to said AC motor;

b. an H-Bridge inverter wherein said DC voltage levels are applied to said AC motor in a predetermined stepwise fashion for directly generating a pulsed AC waveform and for directly driving said AC motor; and c. a micro-controller with embedded software means for generating switching signals to said inverter, each said signal having a predetermined duration for sequencing the formation of said AC driving waveform, said software means further comprising means varying the durations of said switching signals as a function of the desired driving frequency of said AC motor for varying the speed of said AC motor.

2. The apparatus of claim 1 wherein said AC motor is an AC synchronous motor.

3. The apparatus of claim 1 wherein said AC motor is an AC permanent magnet synchronous motor (PMSM).

4. The AC permanent magnet synchronous motor in claim 3 wherein said motor further incorporates rotor means for directly driving a fluid.

5. The apparatus of claim 1 wherein said voltage setting means comprises a multiplicity of adjustable voltage regulators.

6. The apparatus of claim 1 wherein said AC driving waveform is a voltage-stepped approximation of a sine wave.

7. An apparatus for varying the speed of an AC permanent magnet synchronous motor (PMSM) pump comprising:

a. voltage setting means generating a multiplicity of increasing DC voltage levels for application in a predetermined pulsed fashion to said PMSM pump;

b. an H-Bridge inverter wherein said DC voltage levels are applied to said PMSM pump in a predetermined stepwise fashion for directly generating a pulsed AC waveform and for directly driving said PMSM pump; and c. a micro-controller with embedded software means for generating switching signals to said inverter, each said signal having a predetermined duration for sequencing the formation of said AC driving waveform, said software means further comprising means varying the durations of said switching signals as a function of the desired driving frequency of said permanent magnet synchronous motor for varying the speed of said PMSM pump.

8. A method of varying the frequency of an AC synchronous motor so as to vary its speed comprising the steps of:

a. setting a desired number of voltage levels that are to be used in the generation of a stepped approximation to a given AC waveform;

b. calculating the value of each voltage level so that a pulse at said each voltage level will be proportional to the corresponding area for each portion of said given AC waveform, said calculating resulting in a set of calculated voltage levels;

c. calculating for each desired frequency of said AC synchronous motor the set of pulse widths corresponding to said set of voltage levels; and d. applying said set of voltage levels and said set of pulse widths in a predetermined manner to said AC synchronous motor so as to directly generate a pulsed waveform approximating said given AC waveform at said desired frequency.

9. The method of claim 8 wherein said given AC waveform is sinusoidal.

* * * * *